US007891972B2

(12) United States Patent
Blank et al.

(10) Patent No.: US 7,891,972 B2
(45) Date of Patent: Feb. 22, 2011

(54) GAS REGULATING FITTING

(75) Inventors: Jürgen Blank, Gernrode (DE); Barbara Happe, Gernrode (DE)

(73) Assignee: Mertik Maxitrol GmbH & Co. KG, Thale (DE)

( * ) Notice: Subject to any disclaimer, the term of this patent is extended or adjusted under 35 U.S.C. 154(b) by 936 days.

(21) Appl. No.: 10/592,002

(22) PCT Filed: Mar. 10, 2005

(86) PCT No.: PCT/EP2005/002522

§ 371 (c)(1),
(2), (4) Date: Sep. 7, 2006

(87) PCT Pub. No.: WO2005/088195

PCT Pub. Date: Sep. 22, 2005

(65) Prior Publication Data

US 2007/0275334 A1 Nov. 29, 2007

(30) Foreign Application Priority Data

May 12, 2004 (DE) ..... 10 2004 012 202

(51) Int. Cl.
*F23Q 9/08* (2006.01)

(52) U.S. Cl. ..... 431/46; 431/14; 431/69; 431/75; 431/77; 431/80

(58) Field of Classification Search ..... 431/14, 431/15, 17, 69, 75, 77, 80, 83, 89, 46
See application file for complete search history.

(56) References Cited

U.S. PATENT DOCUMENTS

| | | | | |
|---|---|---|---|---|
| 4,915,613 A | | 4/1990 | Landis et al. | |
| 5,787,874 A | * | 8/1998 | Krohn et al. | 126/39 BA |
| 6,029,705 A | | 2/2000 | Happe | |
| 6,247,919 B1 | * | 6/2001 | Welz et al. | 431/13 |

FOREIGN PATENT DOCUMENTS

| | | | |
|---|---|---|---|
| DE | 197 46 788 | C1 | 5/1999 |
| EP | 0 732 544 | A2 | 3/1996 |
| EP | 1 103 766 | A2 | 11/2000 |
| EP | 1 188 989 | A2 | 9/2001 |
| FR | 2 561 757 | A1 | 3/1984 |
| WO | 2004/001292 | A1 | 12/2003 |

* cited by examiner

*Primary Examiner*—Alfred Basichas
(74) *Attorney, Agent, or Firm*—Howard & Howard Attorneys PLLC

(57) ABSTRACT

The aim of the invention is to create a gas regulating fitting which, once a gas stove has been successfully started up, can switch the pilot burner into the off position when the main burner is in the off position, in order to maintain the power consumption of the gas stove as low as possible. The aim of the invention is also to provide the gas regulating fitting with as simple a structure as possible. To this end, the gas regulating fitting comprises a sensor (34) by which means the operating state of the main burner (33) can be detected. The sensor (34) is connected to a thermoelectric safety pilot valve (17) in such a way that, when the operating state of the main burner (33) is switched from the on position into the off position by a signal emitted from the sensor (34), the thermoelectric safety pilot valve (17) assumes the closed position thereof. The gas regulating fitting can be used to ignite and to regulate a gas flow flowing to a burner.

5 Claims, No Drawings

GAS REGULATING FITTING

TECHNICAL FIELD

The invention relates to a gas regulating fitting for a gas fire or the like in accordance with the first patent claim.

PRESENT TECHNOLOGY

There are many different types of gas control devices for a gas fire or the like. Their function is to ignite and control or regulate the flow of gas flowing to a burner.

For instance, DE 197 46 788 C1 describes a gas regulating fitting intended to be fitted mainly in a gas-heated fire installed in the fireplace or the like. The valve enables the burner to be operated and monitored. The burner is divided into a pilot burner and a main burner. To cater for this structure the gas regulating fitting has a start-up system with a flame failure device and a safety interlock to prevent re-ignition, together with a control unit to control the volume of gas flowing into the main burner. The gas flow flowing to the pilot burner is manually ignited by a piezoelectric igniter forming part of the start-up system.

A similar gas regulating fitting is known from DE—application ref. 103 05 929.6. This gas regulating fitting also has a start-up system with a flame failure device and a control unit to control the volume of gas flowing to the main burner. However, with this gas regulating fitting, control and ignition are provided by an electronic control unit. An option with this device is for the flow of gas flowing to the pilot burner to be ignited by a piezoelectric igniter as well.

A disadvantage with both versions is that the pilot flame continues to burn from the time the gas fire is started until it is switched off.

DESCRIPTION OF THE INVENTION

The task of the invention is to devise a gas regulating fitting which, after the gas fire has been started up, moves the pilot burner to the off position as well when the main burner is in the off position. The aim of this is to keep the gas fire's energy consumption to the minimum. In addition, the gas regulating fitting is to be of as simple a construction as possible.

The problem is solved in accordance with the invention by fitting a sensor to the gas regulating fitting by means of which the operating condition of the main burner can be ascertained. To that end the sensor is connected in such a way to the thermoelectric flame failure device valve that on a change in the main burner's operating condition from "On" to "Off", the thermoelectric flame failure device valve assumes its closed position in response to a signal emitted by the sensor.

In this way a solution was found of eliminating the disadvantages in the current state of technology referred to above. At the same time the solution commends itself by the simplicity of its structure and mode of operation.

The other patent claims form the basis of additional advantageous versions of the invention.

An advantageous version of the gas regulating fitting is produced by positioning a time delay element between the sensor and the thermoelectric flame failure device valve. In this way brief disconnections of the main burner can be blanked out in order to avoid frequent ignitions with a consequent strain on the ignition device.

In addition, different types of sensors can be used. The sensor can consist of a flow sensor that checks whether a flow of gas is flowing to the burner by ascertaining the operating condition of the main burner.

A particularly simple solution is where the sensor consists of a temperature sensor that ascertains the operating condition of the main burner by the temperature at the main burner.

A further possibility is to place the sensor right by the control unit controlling the volume of gas flowing to the main burner in order to ascertain the operating condition of the main burner.

EXECUTION EXAMPLE

The gas regulating fitting in accordance with the invention will now be explained in more detail by means of the following execution example. The execution example shows in schematic representation a version of a gas regulating fitting in cutaway view in the open position.

The example of the gas regulating fitting in accordance with the invention illustrated in the figure is a switching and control device intended mainly for installation in a gas fire or the like. It enables a burner to be operated and monitored by controlling the volume of gas flowing to the burner. In this execution example the burner consists of a pilot burner 32 and a main burner 33.

The gas regulating fitting consists of a housing 1 with a gas inlet 2, a pilot gas outlet 3 and a main gas outlet 4. The individual functional units are located in the housing 1.

An electronic control unit 5 serves as a means of control and in this execution example is located together with a power source in a separate housing of a remote control unit 6 that can be at a different location.

The following functional units are housed in the gas regulating fitting illustrated:

Start-up system 7 with flame failure device and main valve 35

Control unit 8 to control the volume of gas flowing to the main burner 33

For the start-up system 7 an operating rod 10 is carried longitudinally in a bearing 9 of the housing 1. The rod is activated by the remote control unit 6 via an electromagnet 11 positioned on the housing 1 with the necessary gas tightness being ensured by round rings 12, for example.

Movement in a longitudinal direction is possible here only against the force of a return spring 13 supported in the housing 1. The starting position to be assumed under the force of the return spring 13 is reached by means of a counter bearing 14 located on the operating rod 10. In the starting position the counter bearing is in contact with a stop that is not illustrated. The end of the operating rod 10 extends into the interior of the housing 1.

The interior of the housing 1 is divided by a partition 15 into different chambers. Aligned in the extension of the operating rod 10, the partition 15 has an initial aperture 16, which on one side together with a valve head 36 located on the operating rod 10 forms a main valve 35 and on the other side forms part of a flame failure device valve 17. The pilot gas outlet 3 is located between the flame failure device valve 17 and the main valve 35 within the aperture 16. The flame failure device valve 17 is activated by a thermoelectric flame failure device magnet 18 positioned in a bearing of the housing 1 and made gastight. The magnet is located downstream of the gas inlet 2. The thermoelectric flame failure device magnet 18 acts on an anchor 19 that is connected rigidly to a valve rod 20 on which the valve head 21 of the flame failure device valve 17 is attached. The thermoelectric flame failure device magnet 18 is energized by the electronic control unit 5 as well as by a thermo element 22 exposed to the pilot flame.

Experts in this field are however familiar with the structure and mode of operation of the flame failure device magnet 18 so that it is unnecessary to go into any further details. All that remains to be emphasized is that a return spring 23 seeks to pull the anchor 19 from the flame failure device magnet 18 over the valve head 21 serving as a spring bearing.

A switch 24 forming part of the control unit 8 is located in the direction of flow behind the start-up system 7 within the housing 1. The switch 24 is of a known design. It is designed in such a way that the valve 25 provides a modulating control and the valve 26 provides abrupt switching on and off in partial load operation, with the flow of gas for partial load operation being limited by the cross-section of the aperture 27 located in the partition.

The plunger 28, which is connected to the switch 24 and actuated by spring force, is movable longitudinally. The plunger protrudes from the housing 1 which at the same time forms a bearing 29 for it. The required gas tightness is achieved by the use of a round ring 30, for example. The plunger 28 is connected by its end facing away from the switch 24 with a drive unit 31 that is not explained in detail as experts in this field will be familiar with its operation. The drive unit 31 is controlled by the remote control unit 6 via the electronic control unit 5.

A temperature sensor 34, in this example a NTC resistance temperature sensor, is fitted in the immediate vicinity of the flames of the main burner 33. The sensor is connected electrically to the electronic control unit 5, which for its part already has a connection for controlling the flame failure device magnet 18 of the thermoelectric flame failure device valve 17. For reasons that are explained in more detail later, a time delay unit is connected in series in the electronic control unit 5.

The mode of operation of the gas regulating fitting is as follows:

After start-up and resultant ignition of the pilot flame by means of an ignition electrode 37, the drive unit 31 is activated by the remote control unit 6 and the electronic control unit 5. This opens the switch 24 in a manner that is known: the switch opens abruptly. The constant volume of gas limited by the aperture 27 flows via the main gas outlet 4 to the main burner 33 where it is ignited by the pilot flame. The flames burn at a minimum height and the temperature sensor 34 is heated. On further activation of the drive unit 31, the volume of gas flowing to the main burner 33 is steadily increased. From this point the switch 24 is in modulating operation and the valve 25 is steadily opened until the maximum volume of gas has been reached.

If, owing to a reduced demand for energy, the switch 24 is now closed by the drive unit 31, i.e. first the valve 25 and then the valve 26 is closed as well, the flames of the main burner 33 are extinguished, thereby causing a fall in the temperature at the temperature sensor 34. This information is evaluated in the electronic control unit 5, whereupon the thermoelectric flame failure device valve 17 is closed. As already previously indicated, the thermoelectric flame failure device valve 17 in this execution example does not close immediately but only after a time delay. This is to avoid re-ignition of the pilot burner 32 with a resultant additional load on the ignition device, should a brief re-ignition of the main burner 33 be necessary, as can happen with room temperature controls in particular.

The gas regulating fitting in accordance with the invention is not, of course, restricted in its application to the execution example illustrated. On the contrary, changes, modifications and combinations can be made within the framework of the invention.

For example, the gas regulating fitting can, of course, have additional functional units, such as a pressure regulator and the like, apart from the units referred to previously. In addition, checks on the temperature at the temperature sensor 34 can be made at specified intervals rather than continuously, and/or can be made only when the drive unit 31 is activated.

Furthermore, the thermoelectric flame failure device valve 17 can be controlled and switched off directly, if for example there is no electronic control unit 5.

EXPLANATION OF REFERENCE NUMERALS

1 Housing
2 Gas inlet
3 Pilot gas outlet
4 Main gas outlet
5 Control unit
6 Remote control unit
7 Start-up system
8 Control unit
9 Bearing
10 Operating rod
11 Electromagnet
12 Round ring
13 Return spring
14 Counter bearing
15 Partition
16 Aperture
17 Flame failure device valve
18 Flame failure device magnet
19 Anchor
20 Valve rod
21 Valve head
22 Thermoelement
23 Return spring
24 Switch
25 Valve
26 Valve
27 Aperture
28 Plunger
29 Bearing
30 Round ring
31 Drive unit
32 Pilot burner
33 Main burner
34 Temperature sensor
35 Main valve
36 Valve head
37 ignition electrode

The invention claimed is:

1. Gas regulating fitting for a gas fire or the like comprising:

a housing defining a gas inlet (2), a pilot gas outlet (3), a main gas outlet (4), and an initial aperture (16) having a first opening in fluidic communication with the gas inlet (2), a second opening in fluidic communication with the main gas outlet (4), and a third opening in fluidic communication with the pilot gas outlet (3);

a thermoelectric flame failure device valve (17) disposed between the gas inlet (2) and the initial aperture (16) for opening and closing the first opening to regulate gas flow between the gas inlet (2) and the initial aperture (16);

a main valve (35) disposed between the initial aperture (16) and the main gas outlet (4) for opening and closing the second opening to regulate gas flow between the initial aperture (16) and the main gas outlet (4);

wherein the valves serve jointly both as a flame failure device and as a means of dividing the flow of gas into a flow of gas for a main burner (33) via the main gas outlet (4) and a pilot burner (32) via the pilot gas outlet (3), a control unit (8) positioned downstream of the main valve (35) for controlling the flow of gas flowing to the main burner (33); and a sensor (34) for ascertaining the operating condition of the main burner (33), whereby the sensor (34) is connected to the thermoelectric flame failure device valve (17) in such a way that on a change in the operating condition of the main burner (33) from "On" to "Off", a signal emitted by the sensor (34) causing the thermoelectric flame failure device valve (17) to close the first opening.

2. Gas regulating fitting according to claim 1, wherein a time delay element is positioned between the sensor (34) and the thermoelectric flame failure device valve (17).

3. Gas regulating fitting according to claim 1 or 2, wherein the sensor (34) includes a flow sensor which ascertains the operating condition of the main burner (33) via the flow of gas flowing to the main burner (33).

4. Gas regulating fitting according to claim 1 or 2, wherein the sensor (34) includes a temperature sensor which ascertains the operating condition of the main burner (33) via the temperature at the main burner (33).

5. Gas regulating fitting according to claim 1 or 2, wherein the sensor (34) is connected to the control unit (8) in order to ascertain the operating condition of the main burner (33).

* * * * *

UNITED STATES PATENT AND TRADEMARK OFFICE

CERTIFICATE OF CORRECTION

PATENT NO. : 7,891,972 B2
APPLICATION NO. : 10/592002
DATED : February 22, 2011
INVENTOR(S) : Jürgen Blank et al.

It is certified that error appears in the above-identified patent and that said Letters Patent is hereby corrected as shown below:

On the Title Page after "5 Claims,", please delete "No Drawings" and replace with -- 1 Drawing --

IN THE DRAWINGS:

Add Figure 1 as shown:

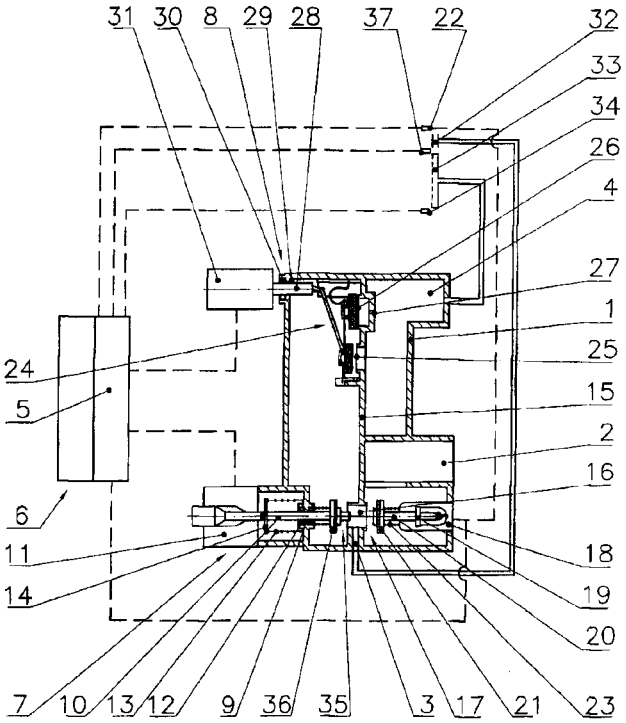

Fig. 1

Signed and Sealed this
Eleventh Day of October, 2011

David J. Kappos

David J. Kappos
*Director of the United States Patent and Trademark Office*

(12) United States Patent
Blank et al.

(10) Patent No.: US 7,891,972 B2
(45) Date of Patent: Feb. 22, 2011

(54) GAS REGULATING FITTING

(75) Inventors: Jürgen Blank, Gernrode (DE); Barbara Happe, Gernrode (DE)

(73) Assignee: Mertik Maxitrol GmbH & Co. KG, Thale (DE)

( * ) Notice: Subject to any disclaimer, the term of this patent is extended or adjusted under 35 U.S.C. 154(b) by 936 days.

(21) Appl. No.: 10/592,002

(22) PCT Filed: Mar. 10, 2005

(86) PCT No.: PCT/EP2005/002522

§ 371 (c)(1),
(2), (4) Date: Sep. 7, 2006

(87) PCT Pub. No.: WO2005/088195

PCT Pub. Date: Sep. 22, 2005

(65) Prior Publication Data

US 2007/0275334 A1 Nov. 29, 2007

(30) Foreign Application Priority Data

May 12, 2004 (DE) ..... 10 2004 012 202

(51) Int. Cl.
*F23Q 9/08* (2006.01)

(52) U.S. Cl. ..... 431/46; 431/14; 431/69; 431/75; 431/77; 431/80

(58) Field of Classification Search ..... 431/14, 431/15, 17, 69, 75, 77, 80, 83, 89, 46
See application file for complete search history.

(56) References Cited

U.S. PATENT DOCUMENTS 4,915,613 A 4/1990 Landis et al.
5,787,874 A * 8/1998 Krohn et al. ..... 126/39 BA
6,029,705 A 2/2000 Happe
6,247,919 B1 * 6/2001 Welz et al ..... 431/13

FOREIGN PATENT DOCUMENTS

| | | | |
|---|---|---|---|
| DE | 197 46 788 | C1 | 5/1999 |
| EP | 0 732 544 | A2 | 3/1996 |
| EP | 1 103 766 | A2 | 11/2000 |
| EP | 1 188 989 | A2 | 9/2001 |
| FR | 2 561 757 | A1 | 3/1984 |
| WO | 2004/001292 | A1 | 12/2003 |

* cited by examiner

*Primary Examiner*—Alfred Basichas
(74) *Attorney, Agent, or Firm*—Howard & Howard Attorneys PLLC

(57) ABSTRACT

The aim of the invention is to create a gas regulating fitting which, once a gas stove has been successfully started up, can switch the pilot burner into the off position when the main burner is in the off position, in order to maintain the power consumption of the gas stove as low as possible. The aim of the invention is also to provide the gas regulating fitting with as simple a structure as possible. To this end, the gas regulating fitting comprises a sensor (34) by which means the operating state of the main burner (33) can be detected. The sensor (34) is connected to a thermoelectric safety pilot valve (17) in such a way that, when the operating state of the main burner (33) is switched from the on position into the off position by a signal emitted from the sensor (34), the thermoelectric safety pilot valve (17) assumes the closed position thereof. The gas regulating fitting can be used to ignite and to regulate a gas flow flowing to a burner.

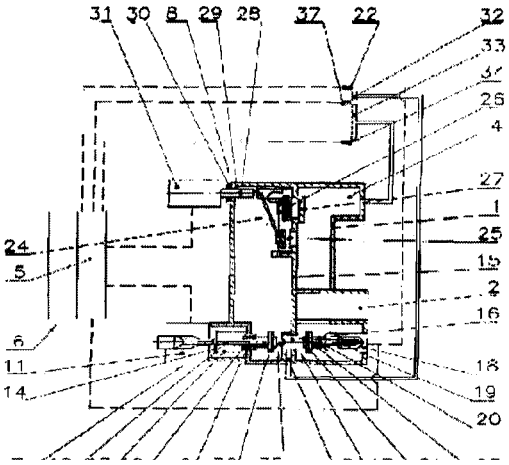

5 Claims, One Drawing